United States Patent [19]

Finkelstein et al.

[11] Patent Number: 4,508,022

[45] Date of Patent: Apr. 2, 1985

[54] CEILING AIR OUTLET

[75] Inventors: Wolfgang Finkelstein, Neukirchen-Vluyn; Hans Riegel, Geldern, both of Fed. Rep. of Germany

[73] Assignee: Gebrueder Trox GmbH, Neukirchen-Vluyn, Fed. Rep. of Germany

[21] Appl. No.: 444,166

[22] Filed: Nov. 24, 1982

[30] Foreign Application Priority Data

Nov. 28, 1981 [DE] Fed. Rep. of Germany ..... 3147224

[51] Int. Cl.[3] ..... F24F 13/075

[52] U.S. Cl. ..... 98/40.12; 98/41.1

[58] Field of Search ..... 98/40 R, 40 B, 40 D, 98/40 VM, 40 N, 41 R

[56] References Cited

U.S. PATENT DOCUMENTS 3,012,493 12/1961 Ekeren ..... 98/40 D
3,631,788 1/1972 Larkfeldt ..... 98/40 D
3,946,647 3/1976 Lärkfeldt ..... 98/40 N X
4,020,752 5/1977 Stephan ..... 98/40 D

FOREIGN PATENT DOCUMENTS 2033195 1/1972 Fed. Rep. of Germany ..... 98/40 D

*Primary Examiner*—Harold Joyce
*Attorney, Agent, or Firm*—Shlesinger Arkwright Garvey & Fado

[57] ABSTRACT

The invention concerns a ceiling air outlet, especially for air-conditioned areas, with a housing which can be connected to a supply air line and has a separating wall, two flow paths and an outlet grate, whereby an adjustment flap is located in at least one of the flow paths. In order to maintain a stable flow of areal air under a variable amount of supply air furnished by the air-conditioning system, the separating wall is positioned essentially parallel to the outlet grate and has at least one opening which can be closed by the adjustment flap. A series of jet openings or jet slits directed toward the outlet grate are located in the separating wall at least in the area of the free edge of the adjustment flap.

20 Claims, 5 Drawing Figures

CEILING AIR OUTLET

The invention concerns a ceiling air outlet, especially for air-conditioned areas, with a housing which can be connected to an air supply line and has a separating wall, two flow paths and an outlet grate, whereby an adjustment flap is located in at least one of the flow paths.

Various types of ceiling air outlets are known. They have the task of distributing air supplied by an air-conditioning system as evenly as possible in the area to be air-conditioned.

In order to maintain an acceptable flow of air in the area, the volume flow can normally be reduced only to ca. 50% when it is injected into the area through outlets with constant exhaust sections. If the volume flow is reduced to less than 50%, problems can occur.

According to the laws of streams, the total volume flow moved in the stream decreases in proportion to the volume flow injected, that is, less areal air is induced. The reduction of the flow speed in the lining zone associated therewith frequently leads to complaints concerning uncomfortableness.

If, however, the speed of the air exhausted drops below a critical level, the direction of the stream also becomes unstable, respectively the direction of the stream changes. Thus, for example, the gravitational effect of injected cold air becomes so great on a ceiling stream, that the stream separates prematurely from the ceiling and enters the living zone with a flow speed which is still too high and at too great a subtemperature. In the extreme case, at a very low exhaust speed, the desired ceiling stream can not even develop at all.

This all applies also to a known ceiling air outlet in which two flow conduits with different-sized sections are formed by separating walls. The flow conduit with the larger section can be closed to a greater or lesser extent by an adjustment flap. The adjustment flap closes more or less, according to the existing flow pressure, so that greater amounts of air flow through the flow conduit with the larger section only when corresponding amounts of air are supplied from the air-conditioning system. On the other hand, a constant amount of air always flows through the flow conduit with the smaller section. Nevertheless, the problems mentioned above also occur here.

The invention therefore has the task of improving a ceiling air outlet of the type initially described in such a manner that the areal air flow remains stable during the variable supply of air from the air-conditioning system.

This task is solved as follows: The separating wall runs essentially parallel to the outlet grate, the separating wall has at least one opening which can be closed by the adjustment flap, and a series of jet openings or jet slits directed onto the outlet grate is located in the separating wall at least in the area of the free edge of the adjustment flap.

The ceiling air outlet of the invention has no separate flow conduits, but rather only separate flow paths through the dividing wall. An induction space is present between the separating wall and the outlet grate, the effect of which can be described as follows. The air supplied from the air-conditioning system flows constantly through the jet openings or jet slits located along the edge of the opening or the adjustment flap. When the adjustment flap is closed, the air streams exiting from the jet openings or jet slits produce a vacuum in the induction space between the separating wall and the outlet grate, so that areal air is drawn into the induction space through the outlet grate. This areal air mixes with the supply air exiting from the jet openings or jet slits and is carried back out into the area with the streams. The amount of areal air sucked into the induction space changes if the adjustment flap is opened. It is possible, by suitably regulating the adjustment flap, to adjust the conditions of flow at all times in such a manner that the total amount of air exiting out of the ceiling air outlet, which consists of supply air and induced areal air, remains constant even during a variable supply of supply air from the air-conditioning system.

The housing can have an essentially rectangular to square section in a projection on the outlet grate. This makes possible, as will be explained later, a clearly arranged construction of the ceiling air outlet which is easily understandable as regards the regulating of a constant total amount.

In particular, the separating wall can have two adjacent openings, each of which is associated with an adjustment flap. The rotation axes of both adjustment flaps should preferably be adjacent to one another and parallel to one another in such a symmetric construction.

Flow conditions which are essentially even in all housing sections can be achieved in particular in a rectangular housing section if air guide grates with lamellas arranged transversely to the rotation axes of the adjutment flaps are provided on the supply air side of the adjustment flaps. The supply air, which usually enters the housing from a side, is diverted by these lamellas in such a manner that the supply air entering through the opening or opening can unite with the streams exiting from the jet openings or jet slits without much vortex formation, i.e. without loss in each section of the housing.

The jet openings or jet slits are arranged with advantage in a crown-like fashion round about the openings, so that a crown of streams is formed below the separating wall, which crown surrounds the induction space initially mentioned.

In order that the streams have sufficient stability, the jet openings should be formed by tubular pieces set on the separating wall. These pieces can taper down conically in the direction of flow if a higher stream speed is desired in the induction space.

There are various possibilities for the regulation of the adjustment flaps. The simplest is to load each adjustment flap with a counterweight which brings the adjustment flap into closed position when the amount of supply air is only slight. As the amount of supply air increases, the pressure on the adjustment flap also rises and the flap opens to a greater or lesser extent according to the pressure conditions which occur. This embodiment also makes it basically possible to achieve a constant total amount which is given off from the ceiling air outlet and consists of supply air and induced areal air.

In other embodiments each adjustment flap can be associated with an adjustment drive with adjustment motor. The flap can then be set according to various points of view.

In one embodiment the adjustment drive is part of a regulating circuit, the actual value indicator of which is a pressure sensor located on the supply air side of the separating wall. The adjustment flap is then adjusted in a regulated fashion according to the pressure which occurs on the supply side of the separating wall, similarly to the embodiment with the counterweight. The pressure sensor measures the static pressure above the separating wall and the regulating circuit is set so that this pressure remains constant.

On the other hand, there is also the possibility of constructing the adjustment drive as a part of a regulating circuit, the actual value indicator of which is a temperature sensor located in the area to be air-conditioned. This embodiment can be used with advantage if a volume flow regulator is connected in before the ceiling air outlet, because then the adjustment drive of the adjustment flap is connected in parallel to an adjustment drive of the volume flow regulator and can be connected together with it into a regulating circuit which keeps the area temperature constant.

Embodiments of the ivention which are shown in the drawings are explained below.

Figure 1:
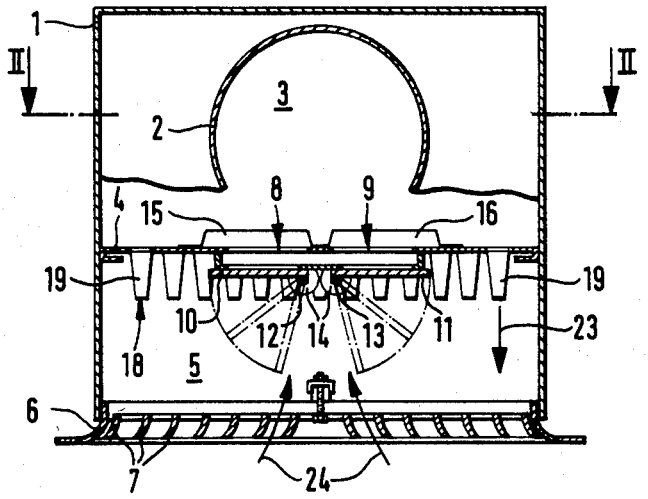
FIG. 1 shows a vertical section through a ceiling air outlet.
Figure 2:
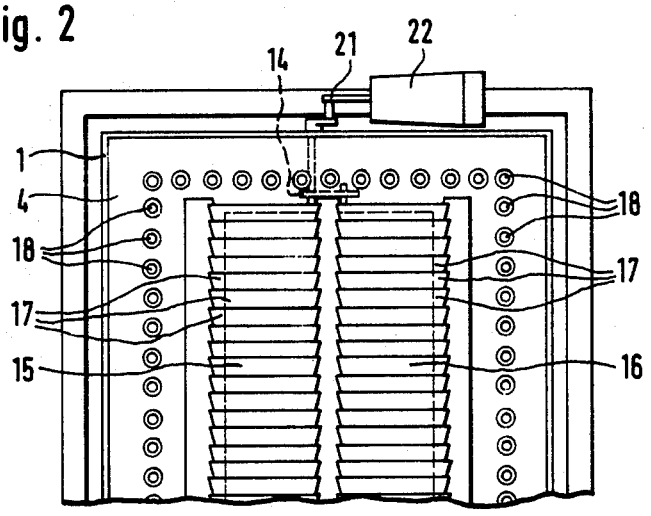
FIG. 2 shows a horizontal section in direction II—II through the object of FIG. 1.

The ceiling air outlet shown in the drawings has a boxlike housing 1 for connection to a supply air line 2. Supply air line 2 empties into upper housing space 3 limited at its bottom by separating wall 4, which separates housing 1 into upper housing space 3 and a lower housing space designated in the following as induction space 5. Outlet grate 6 is located at the bottom of housing 1 and has lamellas 7 which deflect to the side the air exiting from induction space 5, so that in a ceiling air outlet built into a ceiling the exiting air flows along the ceiling and under it.

As the drawings show, separating wall 4 is arranged parallel to outlet grate 6. Two openings 8,9, each of which can be closed by an adjustment flap 10 resp. 11, are located in the middle part of separating wall 6. Adjustment flaps 10, 11 are pivotably mounted on shafts 12, 13 which extend parallel to one another between the two openings 8, 9 and are contrarotatingly coupled to one another at one end of the housing over transmission 14.

Each opening 8, 9 is covered by a straightener 15, resp. 16, the lamellas 17 of which direct the air current passing from upper housing space 3 through openings 8, 9 essentially vertically to the place of separating wall 4.

A series of jet openings 18 is located on separating wall 4 and extends like a crown round about openings 8, 9. Each jet opening 18 consists of a tubular piece 19 whose axis is directed vertically to the plane of separating wall 4. Each piece 19 tapers down conically toward outlet grate 6.

Figure 3:
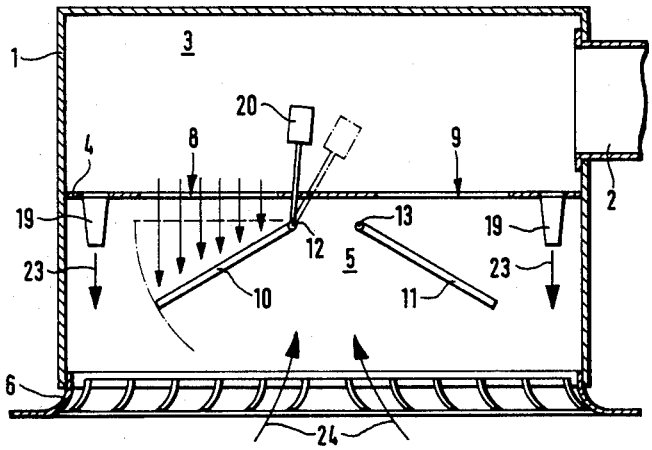
FIG. 3 is a schematic representation of the ceiling air outlet of FIG. 1 with adjustment flaps which can be actuated by a counterweight.

In the embodiment of FIG. 3 each adjustment flap 10 resp. 11 carries a counterweight, under the effect of which the flap is brought into its position of rest when there is no or only a slight air current. When the flap is in this position of rest, it closes the associated opening 8 resp. 9. Only one counterweight 20 for adjustment flap 10 is shown in FIG. 3. It is understood, that adjustment flap 11 also carries a corresponding counterweight.

Figure 4:
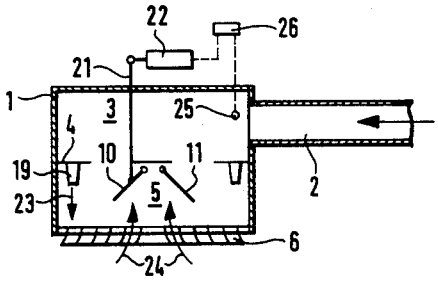
FIG. 4 is a schematic representation of the ceiling air outlet of FIG. 1 with adjustment flaps which can be actuated by adjustment drive.
Figure 5:
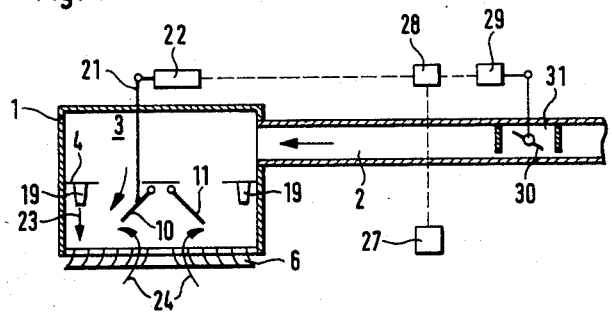
FIG. 5 shows another embodiment of the object of FIG. 4.

In the embodiment of FIGS. 1, 4 and 5 adjustment flaps 10 resp. 11 are connected over transmission 14 and adjustment drive 21 to adjustment motor 22.

The ceiling air outlet shown operates as follows: When only a relatively small amount of air is supplied over supply air line 2 from the air-conditioning system (not shown), adjustment flaps 10, 11 remain in their position of rest, represented in FIG. 1 in unbroken lines; that is, openings 8, 9 are closed. Consequently, the supply air can flow only via jet openings 18 from the upper housing space into the induction space. As jet openings 18 are positioned round about openings, 8, 9, the streams (arrows 23) exiting from these jet openings 18 limit induction space 5 and produce a vacuum in it. Areal air (arrows 24) is accordingly sucked in through outlet grate 6, mixes with the streams of supply air exiting from jet openings 18 and is carried out again together with the supply air from the ceiling air outlet. If the amount of supply air becomes greater, adjustment flaps 10, 11 are opened to a greater or lesser extent, as is indicated in FIG. 1 in dotted lines. Then, the supply air can flow not only through jet openings 18 but also through openings 8, 9 from upper housing space 3 into induction space 5. The pressure difference between induction space and the area to be ventilated is less, so that less areal air (arrows 24) enters into induction space 5.

A suitable regulation of the position of adjustment flaps 10, 11 can keep the total amount of air exiting from the ceiling air outlet, namely, the sum of the amount of supply air and of the amount of areal air, always constant.

The position of adjustment flaps 10, 11 is regulated by counterweight 20 in the embodiment of FIG. 3. In the embodiments of FIGS. 1, 4 and 5 adjustment flaps 10, 11 are set by adjustment motor 22.

In the embodiment of FIG. 4 adjustment motor 22 is part of a regulating circuit whose actual value indicator is a pressure sensor 25 located on the supply air side of separating wall 4. This pressure sensor 25 measures the static pressure in upper housing chamber 3 and signals this pressure to pressure regulator 26, which for its part controls adjustment motor 22.

In the embodiment of FIG. 5 adjustment motor 22 is connected as a correcting element into a regulating circuit whose actual value indicator is a temperature sensor 27 located in the area to be air-conditioned. This temperature sensor 27 signals the area temperature to regulator 28, which regulates not only adjustment motor 22 of adjustment flaps 10, 11 but also another adjustment motor 29, with which a flap 30 of volume flow regulator 31 located in supply air line 2 before the ceiling air outlet is moved. In so far the two adjustment motors 22, 29 are connected in parallel. It is understood, that the regulating characteristic of regulators 26 resp. 28 or counterweight 20 is designed so that the total amount of air exiting from the ceiling air outlet is always constant, regardless of the particular amount of supply air present.

We claim:

1. A ceiling air outlet, in particular for air conditioned rooms, comprising:

(a) a housing;

(b) means associated with said housing for connecting said housing to a supply air duct;

(c) partition means mounted in said housing separating said housing into an upper housing and a lower housing and said means associated with said upper housing for thereto providing supply air;

(d) an outlet grid mounted to said housing parallel to and below said partition means and cooperating therewith for defining an induction space;

(e) at least a first outlet disposed in said partition means;

(f) adjustable baffle means connected to said partition means for adjustably opening and closing said at least a first outlet in response to fluctuations in the volume of supply air; and, (g) a plurality of apertured nozzle means mounted to said partition means disposed about said at least a first outlet projecting into said induction space and communicating with said upper housing so that supply air issuing through said nozzle means creates a vacuum in said induction space causing areal air in the room to be drawn through said outlet grid into said induction space and therewith to mix with the supply air and to therewith issue through said outlet grid so that total amount of air issuing from said outlet grid into the room remains constant and whereby opening and closing of said baffle means in response to the volume fluctuations in supply air proportionately regulates the amount of areal air drawn into said induction space.

2. The outlet as defined in claim 1, wherein:

(a) said outlet grid is generally rectangular in plan view.

3. The outlet as defined in claim 1, wherein:

(a) a first and second outlet are disposed in said partition means; and, (b) said adjustable baffle means includes a baffle means for each of said outlets.

4. The outlet as defined in claim 3, wherein:

(a) each of said baffle means includes a flap pivotally mounted to said partition means.

5. The outlet as defined in claim 3, wherein:

(a) said outlets are adjacently disposed;

(b) first and second axles are rotatably mounted to the bottom surface of said partition means in spaced parallel relation and each of said axles is associated with one of said outlets; and, (c) an adjustment flap is connected to each of said axles and is rotatable therewith for adjustably opening and closing the associated outlet.

6. The outlet as defined in claim 5, wherein:

(a) each of said outlets is generally rectangularly-shaped; and, (b) said axles are adjacently disposed.

7. The outlet as defined in claim 1, wherein:

(a) at least a first air guide grate including a plurality of lamellas is connected to the partition means and extends into said upper housing and said at least a first air guide grate is aligned with said at least a first outlet for directing the supply air through said at least a first outlet.

8. The outlet as defined in claim 6, wherein:

(a) a first and second air guide grate are connected to said partition means and extend into said upper housing;

(b) each of said air guide grates is associated with and aligned with one of said outlets; and, (c) each of said air guide grates includes a plurality of spaced lamellas and said lamellas extend in a direction generally transverse to said axles.

9. The outlet as defined in claim 1, wherein:

(a) each of said nozzle means includes a tubular member having one end secured to said partition means and an opposite end extending into said induction space.

10. The outlet as defined in claim 9, wherein:

(a) said tubular members taper conically from said one end to said opposite end.

11. The outlet as defined in claim 4, wherein:

(a) a counterweight is connected to said flap.

12. The outlet as defined in claim 5, wherein:

(a) a counterweight is connected to each of said flaps.

13. The outlet as defined in claim 5, wherein:

(a) transmission means interconnect said axles at generally one end thereof for cooperatively rotating said axles and thereby said flaps; and, (b) drive means are connected to said transmission means for operating said transmission means.

14. The outlet as defined in claim 13, wherein:

(a) pressure sensor switch means are disposed in said upper housing; and, (b) said switch means are connected to said drive means for causing operation of said drive means in response to pressure fluctuations in said upper housing.

15. The outlet as defined in claim 13, wherein:

(a) temperature sensing switch means are disposed in the room to be air conditioned; and, (b) said switch means are connected to said drive means for causing operation of said drive means in response to temperature fluctuations in the room.

16. The outlet as defined in claim 15, wherein:

(a) a volume flow regulator is associated with the supply air duct for varying the volume of supply air supplied to said housing; and, (b) said drive means is connected to said volume flow regulator so that operation of said drive means causes associated cooperative operation of said volume flow regulator.

17. The outlet as defined in claim 2, wherein:

(a) said at least a first outlet is centrally positioned in said partition means.

18. A ceiling air outlet, in particular for air conditioned rooms, comprising:

(a) a generally rectangular housing;

(b) means associated with said housing for connecting said housing to a supply air duct;

(c) a partition plate is mounted in said housing and separates said housing into an upper housing and a lower housing and said means is associated with said upper housing for thereto providing supply air;

(d) an outlet grid is mounted to said housing parallel to and below said partition plate and cooperates therewith for defining an induction space;

(e) first and second generally parallel spaced outlets are disposed in said partition plate and permit flow communication between said upper housing and said lower housing;

(f) baffle means are pivotally connected to the bottom surface of said partition plate for adjustably opening and closing said first and second outlets in response to fluctuations in the volume of supply air; and, (g) a plurality of apertured nozzle means are mounted to said partition plate and disposed about said first and second outlets and project into said induction space and communicate with said upper housing so that supply air issuing through said nozzle means creates a vacuum in said induction space causing areal air in the room to be drawn through said outlet grid into said induction space to therewith mix with the supply air and the mixture thereof to issue through said outlet grid so that the total amount of air issuing from said outlet grid into the room remains constant and whereby opening and closing of said baffle means in response to the volume fluctuations in supply air proportionately regulates the amount of areal air drawn into said induction space.

19. The outlet as defined in claim 18, wherein:

(a) said baffle means includes a first and second axle connected to said partition plate and each of said axles is associated with one of said outlets; and, (b) a flap is connected to each of said axles for opening and closing the associated outlet.

20. The outlet as defined in claim 19, wherein:

(a) means are associated with said partition plate and connected to each of said axles for causing cooperative pivoting of said axles; and, (b) drive means are connected to and operably associated with said transmission means for therewith causing pivoting of said axles upon operation of said drive means.

* * * * *